US007940177B2

(12) United States Patent
Krill

(10) Patent No.: US 7,940,177 B2
(45) Date of Patent: May 10, 2011

(54) SYSTEM AND METHODS FOR MONITORING SECURITY ZONES

(75) Inventor: Jerry A. Krill, Fulton, MD (US)

(73) Assignee: The Johns Hopkins University, Baltimore, MD (US)

( * ) Notice: Subject to any disclaimer, the term of this patent is extended or adjusted under 35 U.S.C. 154(b) by 351 days.

(21) Appl. No.: 12/139,763

(22) Filed: Jun. 16, 2008

(65) Prior Publication Data

US 2010/0045457 A1 Feb. 25, 2010

Related U.S. Application Data

(60) Provisional application No. 60/944,199, filed on Jun. 15, 2007.

(51) Int. Cl.
*G08B 13/08* (2006.01)

(52) U.S. Cl. ..... 340/545.3; 340/541; 340/539.22

(58) Field of Classification Search ..... 340/541, 340/545.3, 551, 552, 553, 555, 556, 557, 340/567, 539.22, 539.26, 539.21; 342/28; 709/228

See application file for complete search history.

(56) References Cited

U.S. PATENT DOCUMENTS 5,149,921 A * 9/1992 Picado ..... 187/317
6,208,247 B1 3/2001 Agre et al.
6,466,157 B1 * 10/2002 Bjornholt et al. ..... 342/28
6,687,571 B1 2/2004 Byrne et al.
6,799,087 B2 9/2004 Estkowski
6,801,819 B1 10/2004 Barto et al.
6,844,814 B2 1/2005 Chin et al.
6,904,335 B2 6/2005 Solomon
7,050,906 B2 5/2006 Hathiram et al.
7,053,770 B2 5/2006 Ratiu et al.
7,126,477 B2 * 10/2006 Gallivan et al. ..... 340/567
7,203,342 B2 4/2007 Pedersen
7,242,294 B2 7/2007 Warrior et al.
7,242,947 B2 7/2007 Niu et al.
7,319,383 B2 1/2008 Howard
2003/0142851 A1 7/2003 Brueckner et al.
2003/0151513 A1 8/2003 Herrmann et al.
2003/0228035 A1 12/2003 Parunak et al.
2005/0251291 A1 11/2005 Solomon
2006/0079997 A1 4/2006 McLurkin et al.
2006/0085106 A1 4/2006 Gaudiano et al.
2006/0161405 A1 7/2006 Munirajan
2006/0220843 A1 10/2006 Broad et al.
2006/0267731 A1 11/2006 Chen
2007/0088499 A1 4/2007 Erignac
2007/0093946 A1 4/2007 Gideoni
2007/0171050 A1 7/2007 Westhoff et al.
2007/0243827 A1 10/2007 Sayeed et al.
2007/0247303 A1 10/2007 Payton
2007/0264938 A1 11/2007 Srinivasan (Continued)

*Primary Examiner* — Van T. Trieu
(74) *Attorney, Agent, or Firm* — Francis A. Cooch

(57) ABSTRACT

A security zone is monitored for intrusion detection by dispersing therein a plurality of sensor nodes that, when an intrusion is detected, communicate with their neighboring sensor nodes without protocols other than a first tone. As the intrusion is detected by more sensor nodes, there is an increase in sensor node transmissions and, hence, an increase in the total power density in the security zone which is detected by a remote monitor for detecting and localizing the intrusion and providing an alert. In addition, certain of the sensor nodes also transmit a continuous second tone received by other sensor nodes. When an intrusion occurs, the transmission is blocked causing the receiving nodes to transmit the first tone to alert neighboring nodes.

45 Claims, 9 Drawing Sheets

U.S. PATENT DOCUMENTS

2007/0296571 A1 12/2007 Kolen
2008/0030324 A1 2/2008 Bekritsky et al.
2008/0262646 A1* 10/2008 Breed ..... 700/226
2009/0309724 A1* 12/2009 Cecil ..... 340/552

* cited by examiner

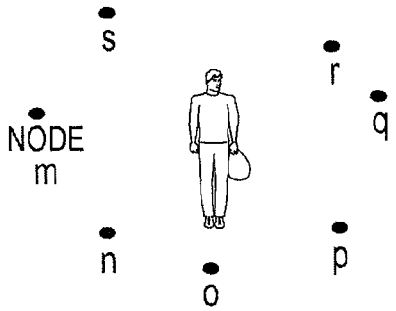

1—SENSOR NODE "o" DETECTS
2—NODE "o" TRANSMITS SIGNAL
3—NODES "n, p, q" RECEIVE SIGNAL
4—NODES "n, p, q" INCREASE SENSITIVITY IN SENSORS IN QUADRANT OF RECEIVED SIGNAL
5—NODES "n & p" DETECT AND SEND SIGNAL
6—NODES "r & s" RECEIVE SIGNAL AND SENSITIZE SENSORS IN RECEIVED SIGNAL QUADRANTS
7—NODES "s" DETECTS AND SENDS SIGNAL
8—NODES "o" SENDS UPDATE SIGNAL SINCE IT CONTINIUES TO DETECT

FIG. 3

SYSTEM AND METHODS FOR MONITORING SECURITY ZONES

CROSS-REFERENCE TO RELATED APPLICATIONS

This application claims the benefit of prior filed, co-pending U.S. provisional application No. 60/944,199, filed on Jun. 15, 2007, which is incorporated herein by reference in its entirety.

BACKGROUND OF THE INVENTION

1. Field of the Invention

The present invention relates generally to monitoring security zones for intrusions and, more particularly, to a system and methods for such monitoring using, in one embodiment, a swarming, inferential sensor node network in combination with shadow/intrusion blockage detection.

2. Description of the Related Art

Various means exist today to monitor, ensure the safety of, and control access to security zones including public and private areas both large and small. Such means include video monitoring, infrared (IR) moving object detectors, and "electric eye" tripwire approaches with IR signals across key pathways.

Shortcomings with the above approaches include: 1) video monitoring is human intensive and requires many high-bandwidth camera nodes; 2) IR moving object detectors are typically placed at predictable locations and can be evaded, disabled, or countered; and 3) IR tripwire paths are specific beams along fixed paths that can be anticipated and evaded.

Distributed sensor network monitoring systems can become very complex because of the numbers of sensors needed (tens of thousands, for example) and the requirement that the sensors cooperate with each other and do so without alerting an intruder. The power requirements for such a system can become prohibitive resulting in a network of only short-term operating life. Furthermore, the complexity of the system and spectral crowding can preclude effective design.

Sensor networks have been developed (see, for example, V. K. Munirajan, "Methods for Locating Targets and Simulating Mine Detection via a Cognitive Swarm Intelligence-Based Approach," Patent Application Pub. No. US 2006/0161405 A1, 20 Jul. 2006, and H. Van Dyke Parunak and S. Brueckner, "Decentralized Detection, Localization, and Tracking Utilizing Distribution Sensors," Patent Application Pub. No. US 2003/0228035 A1, 11 Dec. 2003) but they have complex sensing mechanisms and algorithms.

What is needed, therefore, is a sensor network that uses simple tones with tiny, potentially expendable nodes that make scaling feasible economically as well as technically.

SUMMARY OF THE INVENTION

Therefore, the present invention has been made in view of the above problems, and it is an objective of the present invention to provide a system and methods to monitor security zones.

The system and methods of the invention utilize several key system engineering principles: many simple, yet autonomous, components; very simple interfaces and communications with no, or only the minimum of, protocols; and group "instinct" functions that are similar in each component.

The inventive concept is called a swarming inferential sensor network. It has several unique features:

1. A method of cueing nodes using an inferential form of communications without protocols other than a rudimentary language, e.g., a tone.
2. Swarming in the form of localized, very simple, autonomous actions in response to a cue stimulation among the sensor nodes.
3. A means to remotely monitor the sensor network activity by monitoring and localizing the incoherent power level of the swarming sensors' tones.
4. A means to enter new "instincts" into the swarm.

These features connect an unrestrained number (10-10,000 or more) of potentially very inexpensive sensors (often called smart dust, pebbles, or motes (short for remotes) or, more generally herein, sensor nodes) with very simple "instinctive" programming, allow individual sensors to possess the minimum possible power (detectable by nearest neighbors) via near neighbor detection threshold cuing, prevent detection by their low local electromagnetic, e.g., microwave, energy density via tone based signaling, prevent intruder/evader evasion by the extremely large number of sensor nodes, and, yet, provide adequate control.

More specifically, the inventive system, in one embodiment, comprises a security zone monitoring system comprising: a plurality of sensor nodes dispersed in the security zone, wherein each sensor node transmits a communication without protocols other than a rudimentary language or signal to alert its neighboring sensor nodes when the sensor node detects an intrusion into the security zone and a the alerted neighboring sensor nodes that also detect the intrusion transmit the communication to alert their neighboring sensor nodes, the communication continuing to be transmitted by and through the plurality of sensor nodes that detect the intrusion until the intrusion is no longer detected, whereby an increase in the communication transmissions between the plurality of sensor nodes detecting the intrusion increases a total power density in the security zone; and a transceiver located remotely from the security zone for detecting and localizing the increase in the total power density and for providing an alert of the intrusion.

In another embodiment, the inventive system comprises a security zone monitoring system wherein a portion of the plurality of sensor nodes also transmit a communication comprising a second tone, the second tone being transmitted continuously and being received continuously by neighboring sensor nodes, whereby the intrusion will block the transmission of the second tone thereby causing a receiving neighboring sensor node to detect a resulting drop in the received second tone power and, as a result, to transmit a first tone to its neighboring sensor nodes.

In another embodiment, the inventive system comprises a security zone monitoring system comprising: a plurality of transmitters, the transmitters continuously transmitting EM waves; a plurality of receivers for receiving the transmitted EM waves; wherein an intrusion into the security zone will block the EM wave transmission of one or more of the EM wave transmitters thereby causing one or more of the receivers to detect a resulting drop in the received EM wave transmissions indicating the presence of the intrusion.

In a further embodiment, the inventive system comprises a security zone monitoring system comprising a transceiver located remotely from the security zone for detecting and localizing an increase in the total incoherent power density resulting from communications between a plurality of transmitters located in the security zone when an intrusion is detected by the plurality of transmitters and for providing an alert of the intrusion.

One embodiment of the inventive method comprises a method for monitoring a security zone comprising: dispersing a plurality of sensor nodes in the security zone; transmitting a communication without protocols other than a rudimentary language or signal between the plurality of sensor nodes that detect an intrusion into the security zone, the communication continuing to be transmitted by and through the plurality of sensor nodes that detect the intrusion until the intrusion is no longer detected, whereby an increase in the communication transmissions between the plurality of sensor nodes detecting the intrusion increases a total power density in the security zone; and detecting and localizing the increase in the total power density and providing an alert of the intrusion.

A further embodiment of the inventive method comprises transmitting a communication comprising a second tone between a portion of the plurality of the sensor nodes, the second tone being transmitted continuously, receiving the second tone continuously by the portion of the plurality of sensor nodes, whereby the intrusion will block the transmission of the second tone thereby causing the receiving portion of the plurality of sensor nodes to detect a resulting drop in the received second tone power and, as a result, to transmit a first tone.

A further embodiment of the inventive method comprises a method for monitoring a security zone comprising: continuously transmitting EM waves using a plurality of transmitters; and receiving the transmitted EM waves using a plurality of receivers; wherein an intrusion into the security zone will block the EM wave transmission of one or more of the plurality of transmitters thereby causing one or more of the plurality of receivers to detect a resulting drop in the received EM wave transmission indicating the presence of the intrusion.

A further embodiment of the inventive method comprises a method for monitoring a security zone comprising the step of detecting and localizing an increase in a total incoherent power density using a transceiver located remotely from the security zone, the detected and localized power density resulting from communications between a plurality of transmitters located in the security zone when an intrusion is detected by the plurality of transmitters.

The system and methods of the invention are novel in a number of ways. The invention uses simple tones with tiny, potentially expendable sensor nodes that make scaling feasible economically as well as technically. The invention, in one embodiment also uses a novel sensing approach that involves blocking electromagnetic tones exploiting the same minimal tone-based protocol as for communications. This tone approach is difficult to counter by intruders without making themselves even more discoverable.

The inventive concept takes advantage of "swarm engineering," a relatively new concept that generally is considered as the creation of a swarm of agents designed to complete a defined task. The swarm engineering combination of systems engineering and swarm intelligence delivers a capability that, as noted, is (geographically) scalable, i.e., its performance improves in relationship to the capability added and larger and larger areas can be secured without any additional infrastructure. Thus, the concept can be applicable to commercial applications for both small and very large security businesses. The concept is also difficult to counter, is automatic, minimizes power consumption due to cued swarm behavior, reduces probability of detection due to extremely low power tones, is programmable, has design control for detection and false alarm tailoring and only requires low cost components.

BRIEF DESCRIPTION OF THE DRAWINGS

These and other objects, features and advantages of the invention will be apparent from a consideration of the following Detailed Description considered in conjunction with the drawing Figures, in which:

FIG. 3 illustrates neighboring sensor node behavior when an intrusion is detected.

DETAILED DESCRIPTION

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail.

Figure 1:
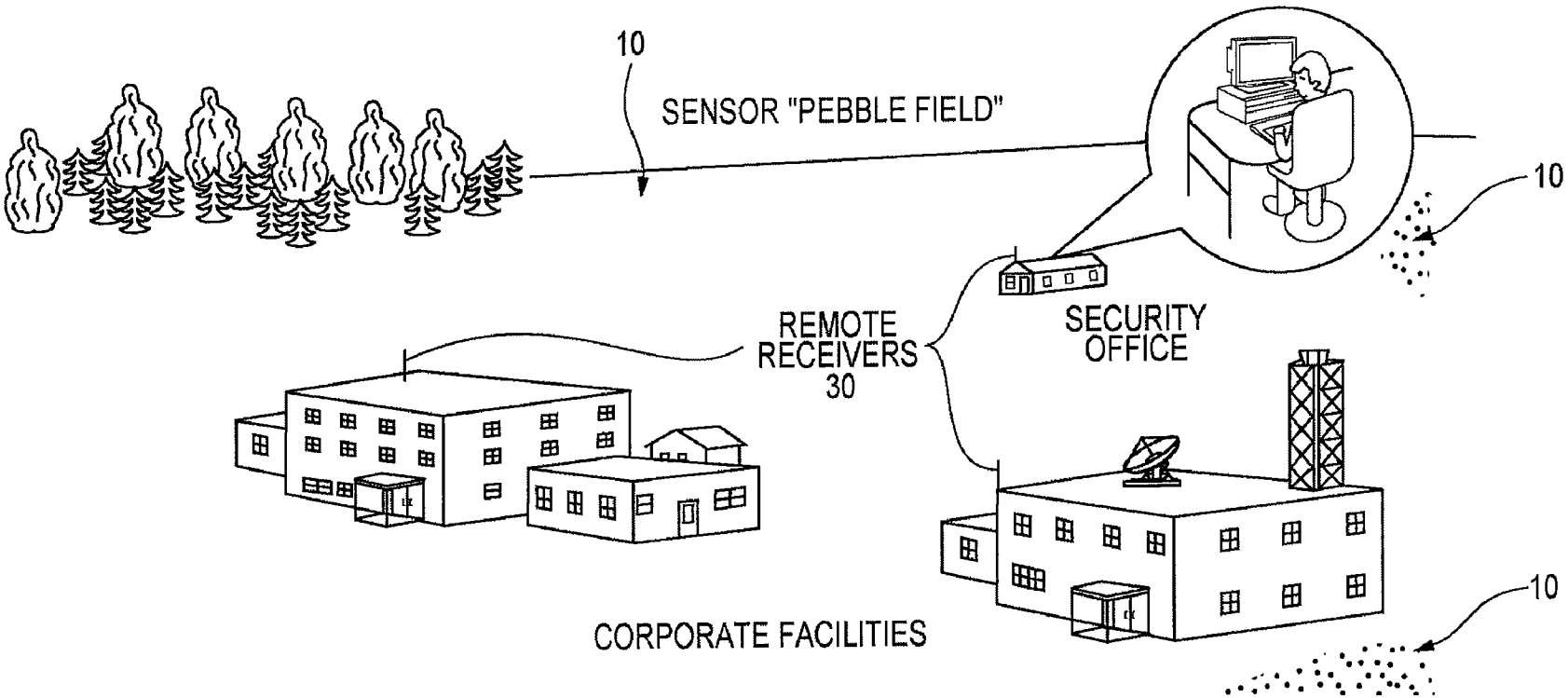
FIG. 1 illustrates a security zone with sensor nodes dispersed therein and remote receivers for detecting an increase in the power density in the sensor node field resulting from an increase in sensor node communications indicating an intrusion in the security zone.

FIG. 1 illustrates the essential elements of the network. A potentially very large N number of sensor nodes 10, disguised as pebbles, can be dispersed, i.e., either randomly distributed (e.g., air dropped) or carefully placed in a "pebble field" in a security zone with the only condition being that some M (<N) number of neighbors are within adjacent sensor node and/or communications coverage, with N and M determined by the mission (e.g., coverage area, sensor range, network connectivity range, and redundancy).

Figure 2A:
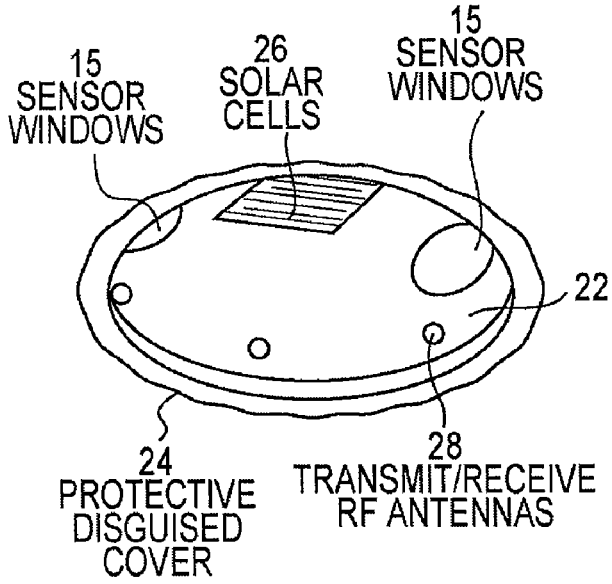
FIG. 2, consisting of FIG. 2A and FIG. 2B, illustrates, respectively, a sensor node or "pebble" of the invention and a block diagram of the sensor node's electronics.
Figure 2B:
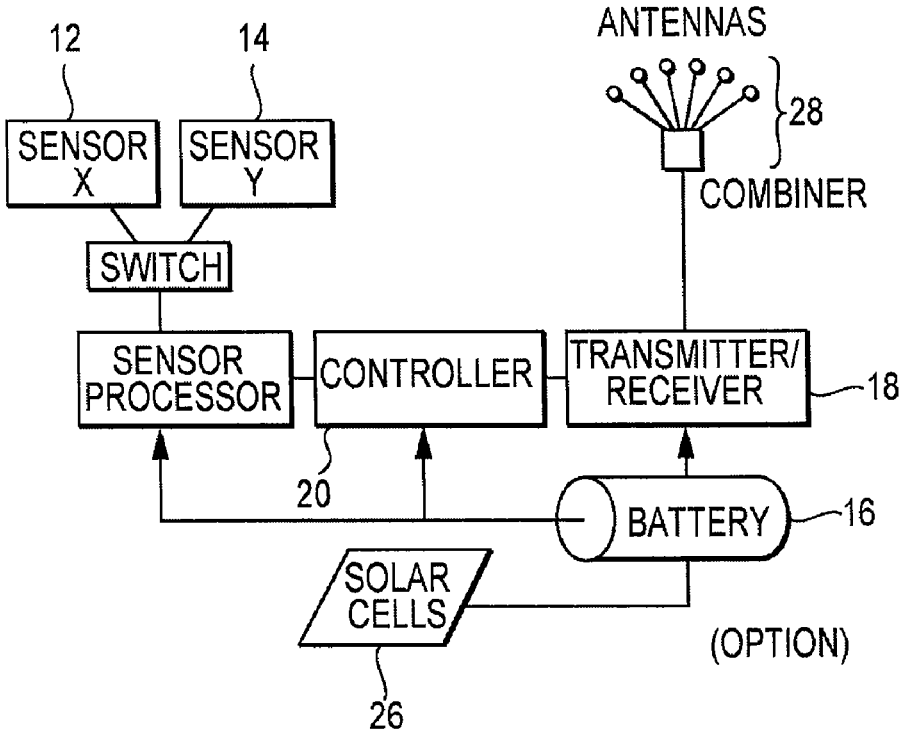

In one embodiment, each sensor node is stationary and unattended. As shown in FIG. 2, each sensor node can contain (a) one or more small, specific sensors 12, 14, e.g., acoustic, radio frequency, chemical, optical, or biological with sensor windows 15 in the sensor node container; (b) a power supply 16; (c) a communications transceiver 18 (two-way communications—can be microwave, millimeter wave, infrared (IR), visible, or ultraviolet (UV)); (d) a controller chip 20; (e) a suitable container 22 and cover 24 to disguise and/or otherwise protect the sensor node components; (f) an optional solar array 26; and (g) one or more antennas 28.

One or more remote directive receivers or transceivers 30 (in FIG. 1) monitor the spectral power density levels and transmission locations of this "pebble field" and, as a design option, can transmit over a "control" channel to modify some number of nodes' programming, for example, detection thresholds. The transceivers can have a directional antenna to localize the intrusion or at least three transceivers can be used for triangulation for the same purpose. The transceivers can also provide an alert to cue video camera(s) and/or an alarm.

The pebble sensor nodes' sensors are passive, i.e., non-emitting for minimum power consumption. All the pebbles can contain the same type of sensor or a mix of different sensor types, perhaps even two or more sensor types per pebble sensor node. The sensors can be preset to search for specific characteristics, such as to detect certain vibration frequencies of the human voice or visual motion or molecules indicative of humans, or they may be set to detect any sound above average background or any moving object, etc.

The detection threshold can also be set. Initially, the threshold would have a reasonably insensitive "cold detection" set value to ensure a low false alarm rate. However, the sensor can be cued to become more sensitive if it receives a cueing signal/tone from its node neighbors indicating that one or more neighbors have detected an intrusion.

For an advanced design, as shown in FIG. 2, a sensor node may have multiple sensors and communication antennas covering different angular sectors to provide directionality to the detection and communication reception. In the simplest case (discussed below), however, each sensor node's sensor and communications are effectively omnidirectional.

In operation, the security zone monitoring system of the invention, in one embodiment, can be applied to detect and locate intrusions into an extensive corporate installation after hours. As shown in FIG. 1, the pebble-sized sensor nodes (perhaps 10,000 to 20,000) have been distributed strategically but somewhat randomly over the landscaping surrounding the buildings, especially adjacent to the doors and any other entry points as well as the perimeter. Although disguised as pebbles, even if they are discovered the sensor nodes are far too numerous to gather.

Assume one sensor node senses an event according to its cold detection preset threshold. It will emit a weak communication in all directions but with intentionally limited range to save energy and to only reach its neighbors, which would likely also have a reasonable probability of detection (PD) if the event is real and not a false alarm. The communication will be without protocols other than a rudimentary language or signal, for example, a tone.

Each sensor node receives the communication from the detecting node over tiny antennas from which it can determine the sector of a received communication. A neighboring receiving sensor node sufficiently close would detect the communication and determine which antenna's sector has the strongest reception and, hence, the general direction of the received communication. The nature of the communication would also indicate the type of sensor used to detect the intrusion, for example, by the frequency of a brief tone or the length of time of a pulse. Those sensor nodes receiving the communication may then cue their own sensors with a more sensitive detection threshold to attempt to detect the intrusion.

If the receiving sensor nodes are directional, e.g., sensor windows in several sector directions, they could attempt to detect only from the direction of the received communication, thereby further reducing the false alarm probability. For example, if the strongest communication tone reception is through an antenna facing north, then the threshold of the sensor(s) in the sector(s) also facing approximately north would be set to be more sensitive. FIG. 3 summarizes this neighboring sensor node behavior.

As each sensor node makes a subsequent associated detection, it continues to emit a simple signal, such as a tone, that can be received by its neighboring sensor nodes. If a correlation of sensor events to an intrusion incident begins to transpire, the activity of the sensor nodes in that area will naturally increase the total power density in that area via their communications transmissions. They will also be inherently collaborating and, by their near-neighbor interactions, producing a swarming behavior. As long as a sensor node continues to detect, it will send a signal to support continuation of the swarming activity. If detections begin to wane, the swarming signals/tones will diminish.

From a distance, a transceiver with a directional antenna tuned to the frequency band(s) or tone(s) of the pebble sensor nodes scans the sensor node field to monitor activity. The directional antenna may, for example, determine sensor node ("pebble") communication activity above normal at a particular direction. The strength of the received signal would be proportional to the strength of sensor node detection activity, implying a firm lead on detecting an intrusion. The angle of reception, e.g., from a direction-finding antenna, indicates the approximate location of the intrusion. As noted above, multiple remote directional receivers could be operated for triangulation to further localize the swarm activity.

Figure 4:
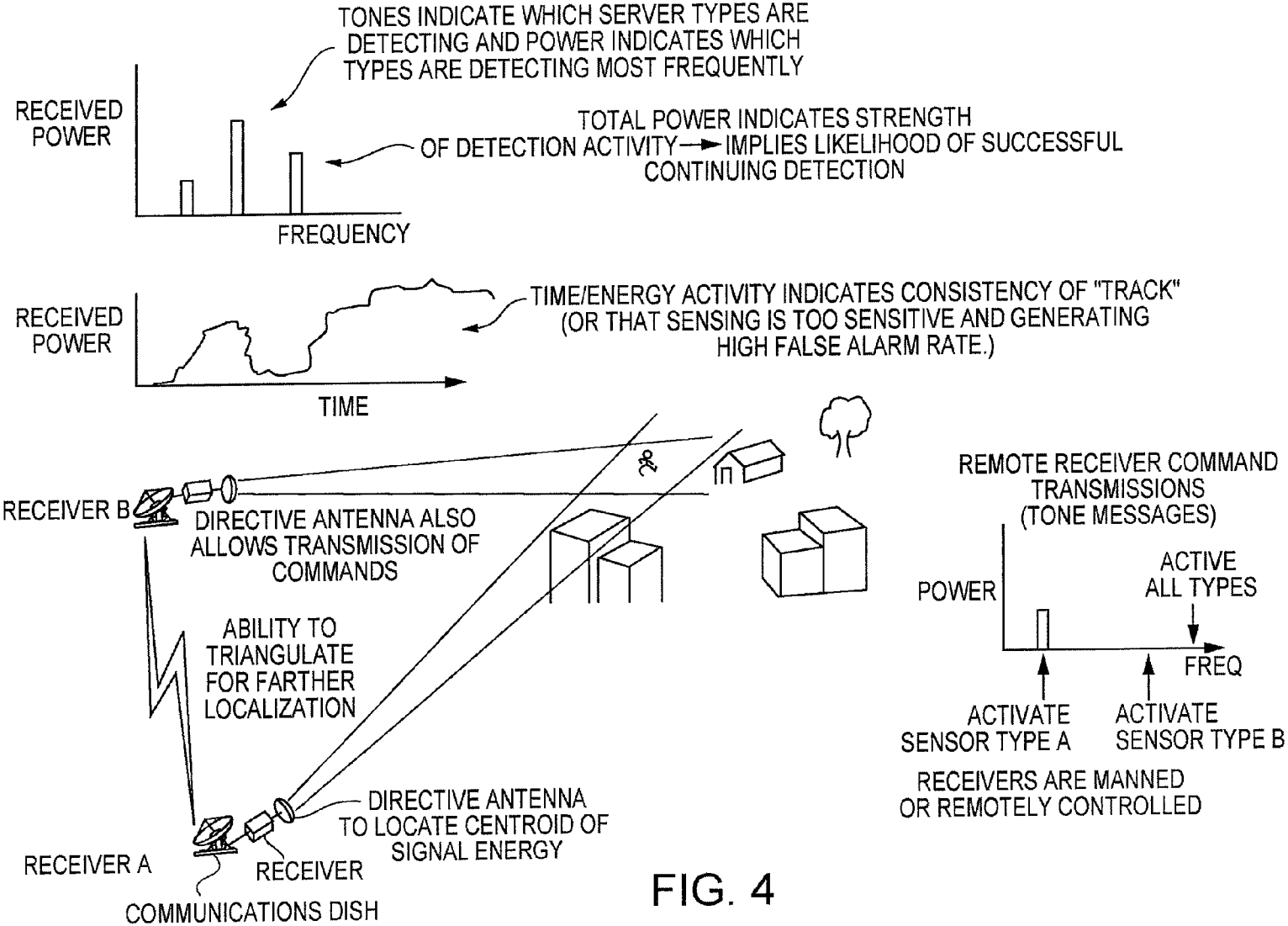
FIG. 4 illustrates the configuration and functions of the remote transceiver element of the invention.

Another localization approach would be to have sensor nodes at different locations radiating at different tonal frequencies. The remote transceiver would be able to link the sensor net activity to a command and control (C2) node for action if indicated. For example, a swarm activity indicating a high confidence of detection could result in a decision to intercept the detected intrusion. The remote receiver could be manned and the C2 decision made at that location, or it could be unmanned and operated remotely via a communications link to a security office. Additional options with this type of operation are cueing of video cameras and tripping an audible or silent alarm if activity of the nodes exceeds a threshold, enabling a response by security forces. FIG. 4 illustrates the remote transceiver configuration and functions.

If a characteristic swarm activity is not detected by the remote transceiver as expected, the remote location can also transmit new commands to the swarm along a control channel in a manner that can minimize detection of the signal for low probability of signal intercept. The simplest of the standard approaches most easily detected by the swarm sensor nodes would be a burst of relatively high power and short duration. Another approach would be to beam (through the directional remote antenna) a control signal to sensor nodes in the part of the field not as likely to have intruder receivers and allow the sensor nodes themselves to relay the control signal to neighboring nodes and propagate the command around the network via near-neighbor interactions.

A more advanced version of the swarming sensor nodes includes a means for locomotion and navigation. If the sensor nodes are capable of some movement, e.g., over a surface or in the air, the cueing and directional reception process could cause the individual sensor nodes to move toward the detected activity. This may also require a means to navigate, hence, requiring a GPS chip and/or INS (with north determination) if complex motions are necessary. Otherwise a simple sensor node could merely move in the quadrant directions of its received communication and modify its direction as additional communications are received.

The purpose of the motion could be a) to maintain track on the object by attempting to remain close; b) allow certain nodes more highly tuned to a specific intruder to get close enough to sense the target and confirm identity; c) to allow certain nodes to mark the target with a tag; or d) to allow certain nodes to engage the intruder, e.g., with an inhalant. This mobile form of sensor node would be much more of the classical swarming behavior in nature. Several forms of simple surface locomotion might be provided for a small rock-sized sensor node. More complex nodes such as unmanned aerial vehicles (UAVs) and even ships could be networked using a similar sensor node net approach.

Consider a sortie of UAVs searching for a target such as a transportable erectable launcher (TEL) or a specific vehicle known to carry a human target of interest. Rather than carrying communications systems (which could cause a stealthy UAV to be detected via its transmissions), assume that each UAV via optical or IR tracking systems monitors the other UAVs in the sortie. The UAV sensors would be passive and include optical, infrared and/or SIGINT/ELINT receivers. In a sense, they are watching each others' "body language" and/or SIGINT/ELINT receivers, e.g., tuned to very low power beacon tones mounted on the fuselage at specific wavelengths.

If one UAV detects and identifies a candidate object of its programmed search it may choose to circle and monitor the object. This will be observed to break from the normal search pattern formation and the other UAVs will detect this change of behavior. They will begin to respond accordingly to support tracking of the object of interest and collecting identification data. Therefore, the other UAVs may establish a cooperative search and ID pattern to confirm the target.

Figure 5:
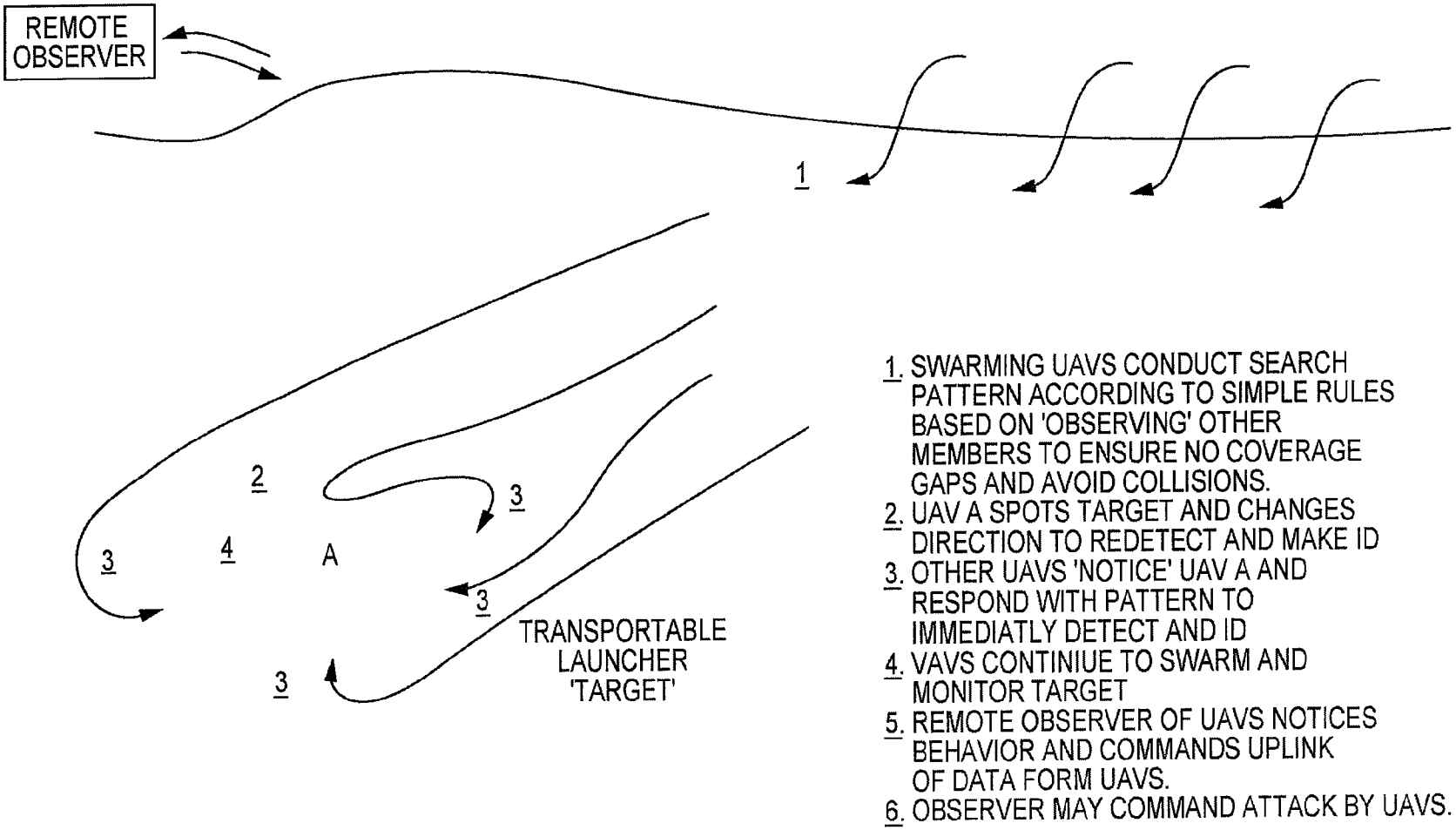
FIG. 5 illustrates the unmanned aerial vehicle (UAV) application of the inventive swarming sensor node concept.

The continuing behavior could be monitored remotely, e.g., via satellite or command aircraft, e.g., via radar track or imaging and a command control response developed to perhaps engage or command the UAVs to break silence and uplink detection and ID data for command decision. This is analogous to swarming buzzards over a 'target'. FIG. 5 illustrates the UAV swarm concept.

An analysis of the inventive swarming network concept can be based on an existing design, the "Mica mote", (see D. E. Culler and H. Malder, "Smart Sensors to Network the World," *Scientific American*, pp. 85-91, June 2004 ("Culler") and J. L. Hill and D. E. Culler, "Mica: A Wireless Platform for Deeply Embedded Networks," *IEEE Micro*, pp. 12-24, November-December 2002 ("Hill"), both incorporated herein by reference in their entireties). Although, perhaps, larger, more costly, and higher power than may ultimately be desired for the sensor node pebbles with the inventive concept, the Mica mote represents a design that may not only be adaptable to inferential swarming behavior but also provides another inventive detection approach called "intrusion blockage detection."

The mote design description found in Culler and Hill indicates up to a 30-m communication range at a moderately high data rate (hundreds of kilobits per second) using the Bluetooth protocol at 2.4 GHz. Based on these characteristics and on power consumption information and, further, recognizing that only narrowband tones are being communicated, the design characteristics for the mote-based sensor node pebbles and a remote transceiver are shown in Table 1.

As noted previously, the assumption is that omnidirectional sensor and communication antennas rather than the more complex sector sensors and antennas discussed previously are being used. Also assumed are expected propagation loss values between sensor nodes and the remote transceiver, assuming potential foliage effects, of up to 15 dB when well within the radio horizon and up to 35 dB at the radio horizon. The radio horizon range depends on receiver heights, e.g., 7.1 km between a surface sensor node and a 3-m-high remote transceiver antenna for standard propagation conditions.

TABLE 1

CHARACTERISTICS FOR PEBBLE NODES AND REMOTE RECEIVER

| | Pebble Node | Remote Receiver |
|---|---|---|
| Noise Figure | 2 dB | 2 dB |
| Bandwidth (Tone) | 50 kHz | 50 kHz |
| Carrier Frequency Range | 2.4 GHz | 2.4 GHz |
| Received Signal to Noise Required (with non-coherent integration) | 12 dB | 12 dB |
| Receive Antenna Loss | 3 dB | 3 dB |
| Antenna Gain | −8 dBi | |
| Transmit Power | −5 dBm (−30 dBm excursion) | |
| Receive Aperture | | 0.025 $m^2$ (0.25 $m^2$ excursion) |

Table 1 includes two levels of sensor node transmit power, −5 dBm of the present mote design and an excursion to a much lower power of −30 dBm representing a potential advanced, very low power design. Also, two remote transceiver antenna apertures are considered: a significant gain, directional antenna of a 0.5-m-by-0.5-m area and a smaller, lower gain antenna with a 16-cm side dimension.

Figure 6:
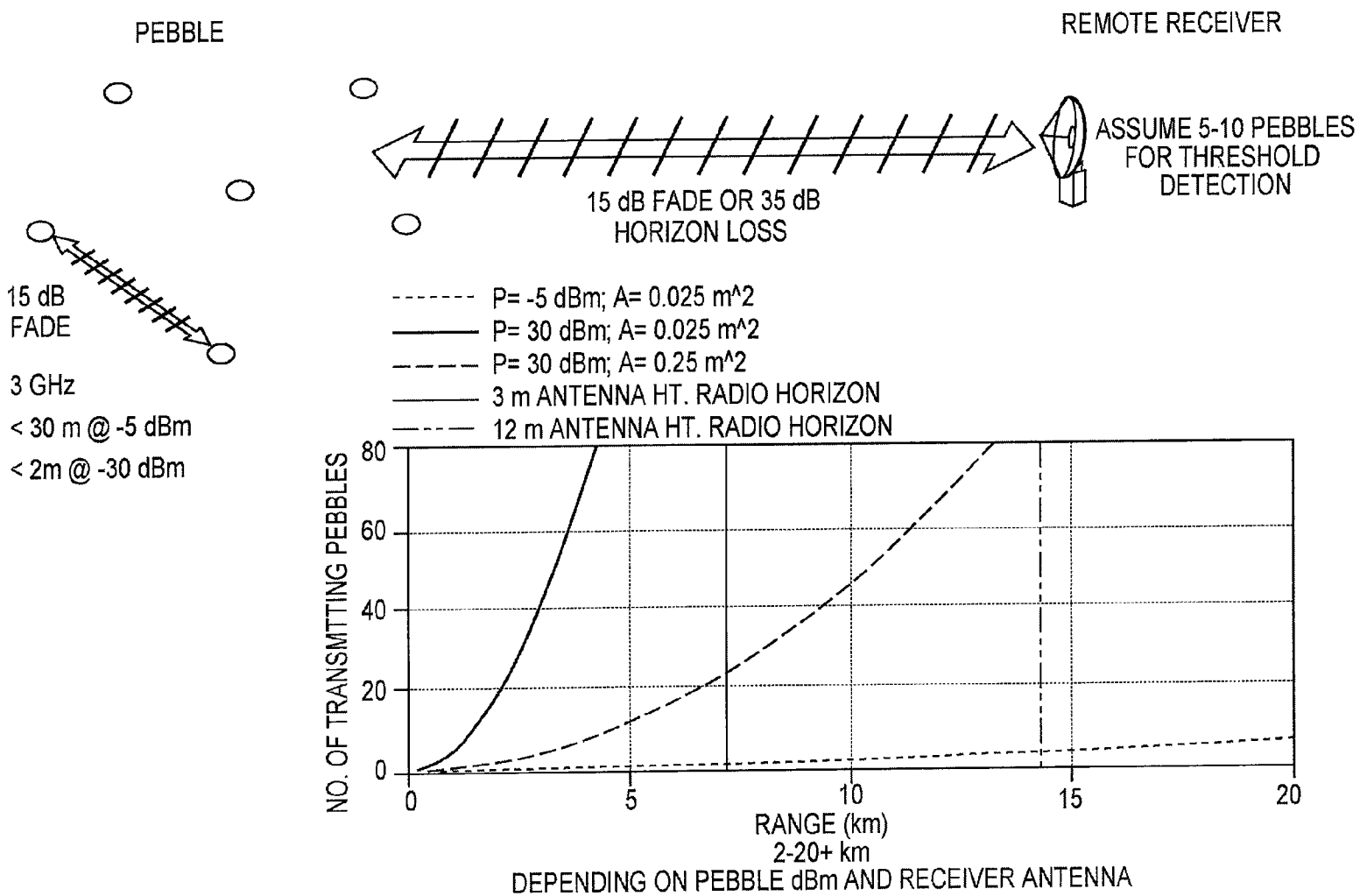
FIG. 6 is a graph illustrating the number of transmitting pebbles vs. range for various pebble transmitting powers and receiver apertures.

FIG. 6 provides example results from parametric calculations of the minimum number of sensor nodes or "pebbles" detectable by a remote transceiver for the combinations of pebble transmit powers and transceiver apertures versus range. It is assumed the pebbles are placed randomly but well within each other's reception range to induce swarming response.

The calculations confirm maximum communications range between pebbles of about 30 m for −5-dB power. If it is assumed that each transmitting pebble has a transmit power of $P_{peb}$ and a transmit gain of $G_{peb}$, and there are N transmitting pebbles, then for non-coherent combining the collection of transmitting pebbles has an average effective radiated power of $NP_{peb}G_{peb}$. The signal-to-noise ratio (SNR) at a distant receiver is then $$\frac{S}{N} = \frac{NP_{peb}G_{peb}A_{rev}\sqrt{tB}}{4\pi R^2(kT_{sys}B)L_pL_s}$$

where:

$A_{rcv}$=receive antenna aperture

R=range to the reveive antenna $kT_{sys}B$=the noise power where k is Boltzmann's constant, $T_{sys}$ is the system noise temperature and B is the receiver bandwidth $\sqrt{tB}$=the S/N improvement factor due to noncoherent integration over a time t $L_pL_s$=the propagation loss and other system losses, respectively In FIG. 6, the parameters of Table 1 and a transceiver noncoherent integration time of 1 sec. are assumed. For ranges well within the radio horizon, a propagation loss of 15 dB to address fading and foliage effects are also assumed. The propagation loss will increase significantly at the radio horizon and beyond. From FIG. 6, for a sensor node transmit power of −30 dBm and a distance of 5 km, a remote transceiver with a 3-m antenna height would detect 12 pebbles or more with a 0.25-$m^2$ aperture. This implies that out of perhaps thousands of pebbles, at least 12 would need to radiate, indicating intruder activity, before the remote receiver would detect any response.

Note that the assumption of noncoherent power combining requires more than a few pebbles to be radiating. Whereas the minimum number of pebbles might ensure a minimum of false alarms, it may also be insufficient to ensure adequate intruder detection sensitivity, e.g., if the pebbles are sufficiently separated and sparse so that a human intruder would only trigger a smaller number of pebbles at any time. Thus, swarming network configuration analysis is likely required to determine the requisite pebble density and remote receiver dynamic detection range for the intruder detection sensor sensitivity.

From the parametric calculations, the conclusion is that, for a pebble transmit power of −5 dBm, a few pebbles can be detected with a remote transceiver with a reasonable antenna aperture under significant propagation loss from 1 to 20 km in range. For a much lower pebble transmit power (−30 dBm) (e.g., to reduce cost and detectability by an adversary intruder), a remote transceiver with a significant antenna aperture could detect the beginning with a few dozen pebbles out to several kilometers.

In light of the mote design, another embodiment of the invention includes a rudimentary, yet difficult to counter, intrusion detection mechanism: intrusion blockage detection. This embodiment can be used alone or in combination with the swarming sensor node concept described above.

Figure 7:
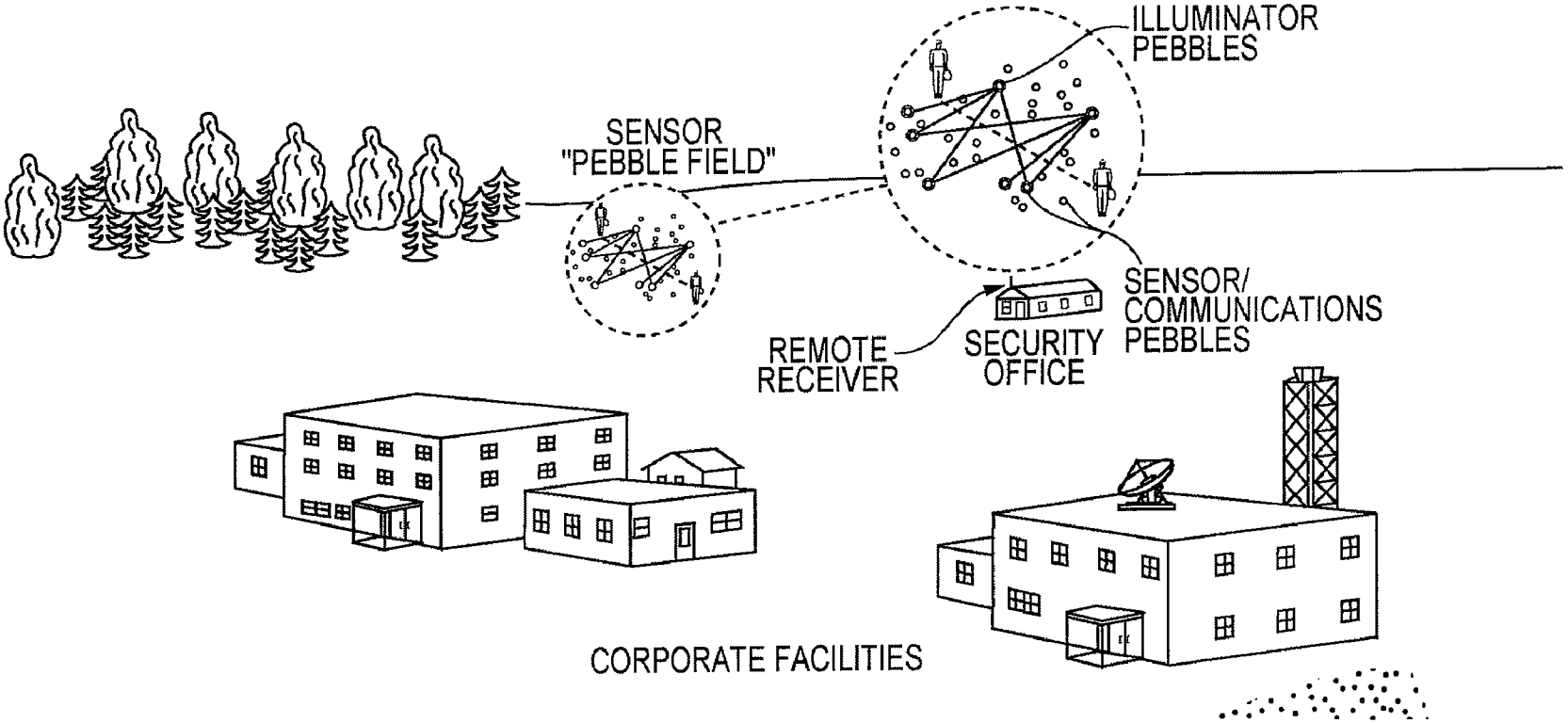
FIG. 7 illustrates security zone "illuminator" sensor nodes or pebbles for use in the intrusion blockage embodiment of the invention.

For the intrusion blockage detection concept, each sensor node is set not only to receive a communication first tone, but also a different frequency blockage-sensing second tone. As shown in FIG. 7, intermixed into the pebbles are several "illuminator" pebbles that continually transmit a low-power, blockage-sensing second tone solely or in addition to the communication first tone. All other pebbles are set to receive the communication first tone as well as the blockage-sensing second tone. The concept is that pebbles will receive rather constant blockage-sensing second tone signal power levels unless an intruder passes through the path between the transmitting pebble and receiving pebble.

Figure 8:
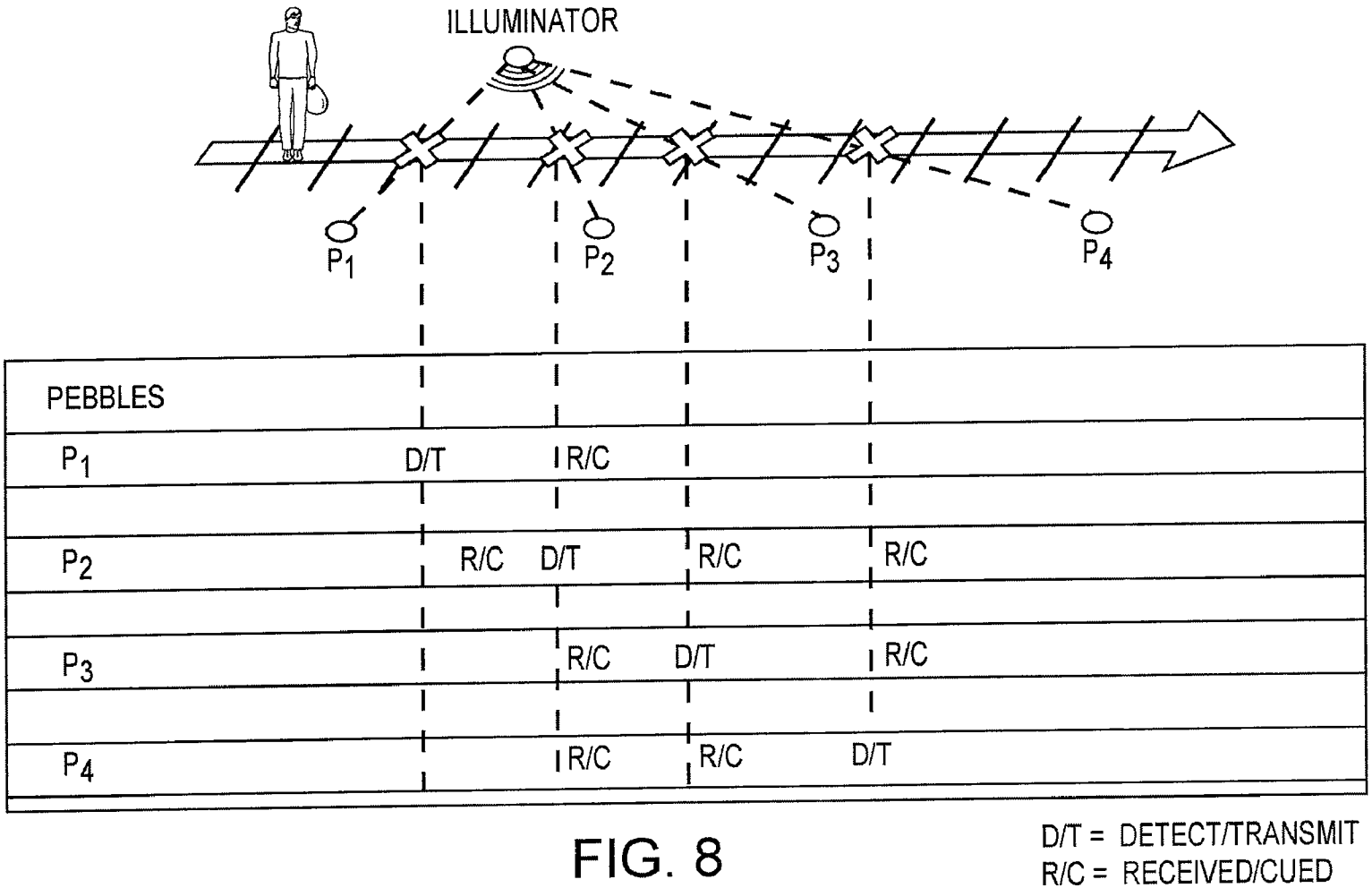
FIG. 8 illustrates the progression of detection and cuing by sensor nodes detecting an intruder directly and by blockage of a tone.

As shown in more detail in FIG. 8 during the passage of an intruder that blocks the blockage-sensing transmission to a receiving pebble, the receiving pebble will detect a significant drop in received signal power for a short period. If that occurs, a potential detection is declared and the pebble emits the 2.4-GHz communication first tone. Upon receiving the communication first tone, the neighboring pebbles increase the sensitivity of their blockage signal triggering threshold so they would detect the loss of signal more readily, i.e., they are cued to "listen" more carefully. Additionally, as discussed above, the sensor node pebbles can also increase the sensitivity of their thresholds for receiving communication first tones from their neighboring nodes and begin the swarming process.

Note that countering blockage detection in the microwave band between several illuminator pebbles and many randomly placed receiving pebbles would likely be difficult to counter. Further mitigation could be in the form of pebble receiver detection of attempts to "jam" the transmission frequency or provision for randomized tone hopping or modulation that would be difficult for an intruder to mimic.

Figure 9A:
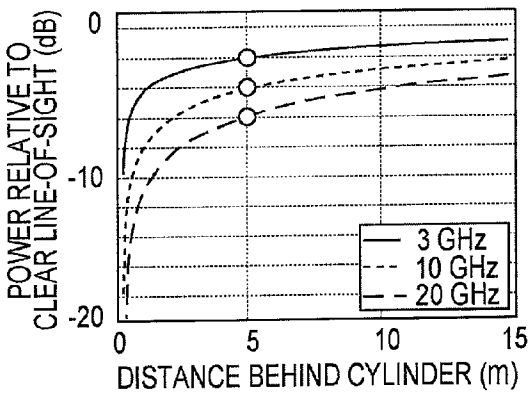
FIG. 9, consisting of FIGS. 9A, 9B, and 9C, illustrates, respectively, a graph illustrating power reduction vs. distance behind a 0.3-m-diameter blocking cylinder for horizontal polarization; a two-dimensional plot of power reduction near a 0.3-m-diameter blocking cylinder for horizontal polarization; and a graph illustrating probability vs. SNR for 20-dB signal case.

Some preliminary diffraction calculations have been performed to determine whether there is adequate blockage signal loss from a human intruder for detection at representative pebble distances. A human intruder was modeled as an infinitely long, vertical cylinder that is 0.3 m in diameter. The cylinder's complex permittivity is that of saltwater to approximate the permittivity of the human body. For such a simple shape, vertical signal polarization causes a deeper shadow than horizontal polarization by 2 to 3 dB. However, because this model ignores irregularities in human shape and composition as well as irregularities in the surface and due to nearby obstacles, which would tend to weaken the polarization effect on the blockage, horizontal polarization is considered as a worst-case. FIG. 9A plots blockage loss versus distance from the obstacle for 3, 10, and 20 GHz blockage-sensing tones.

The signal drop at 2.5 m distance is about 3, 6, and 8 dB for 3, 10, and 20 GHz, respectively. Thus, it appears that using 20 GHz as the blockage-sensing tone provides more effective blockage detection, i.e., a sufficient change in signal against a typical environment for reliable detection by a receiving pebble without excessive false alarms.

Figure 9B:
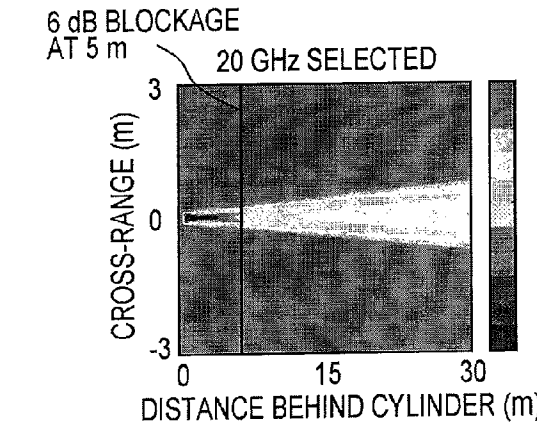

FIG. 9B illustrates the idealized blockage "shadow" in two dimensions for 20 GHz. For this calculation, a parabolic equation computation method described in M. H. Newkirk, J. Z. Gehman, and G. D. Dockery, "Advances in Calculating Electromagnetic Field Propagation Near the Earth's Surface," *Johns Hopkins APL Technical Digest*, vol. 22, no. 4, 2001 was used. The blockage signal loss appears to be significant at 5 to 6 dB, even 10 m behind the blocking cylinder, and some loss at 3 to 4 dB even occurs at the assumed maximum inter-pebble communications distance of 30 m. The conclusion is that a blockage detection capability may be effective against a human intruder near 20 GHz.

A signal power threshold can be set in the remote transceiver requiring some minimum number of sensor nodes to transmit a communications tone to conclude that there may be an intruder, thus further reducing the prospects for a false alarm. The stability of the sensor node network must be maintained so cueing for greater pebble detection sensitivity does not cause the network to go unstable, in which sensitized pebbles continue to detect false alarms after the triggering blockage event has ceased. Greater network stability may be achieved with a timeout feature in which the transmissions of the detecting pebbles cease after, for example, 3 sec and the detection threshold is reset to the "cold detection" value. The timeout approach would also conserve node power.

A preliminary detection and false alarm analysis was performed for the intruder blockage detection approach. A noncentral chi-square distribution was used to model the received signal plus noise power. For received signals 30 dB above thermal noise power, a single pebble cold detection threshold set to detect a drop in signal level of 4 to 6 dB (below the 30-dB level) will yield a very high $P_D$ and very low probability of false alarm. Additional pebble detections correlated with the first detection would not appreciably improve the detection performance, but would indicate intruder movement through the pebble field.

Figure 9C:
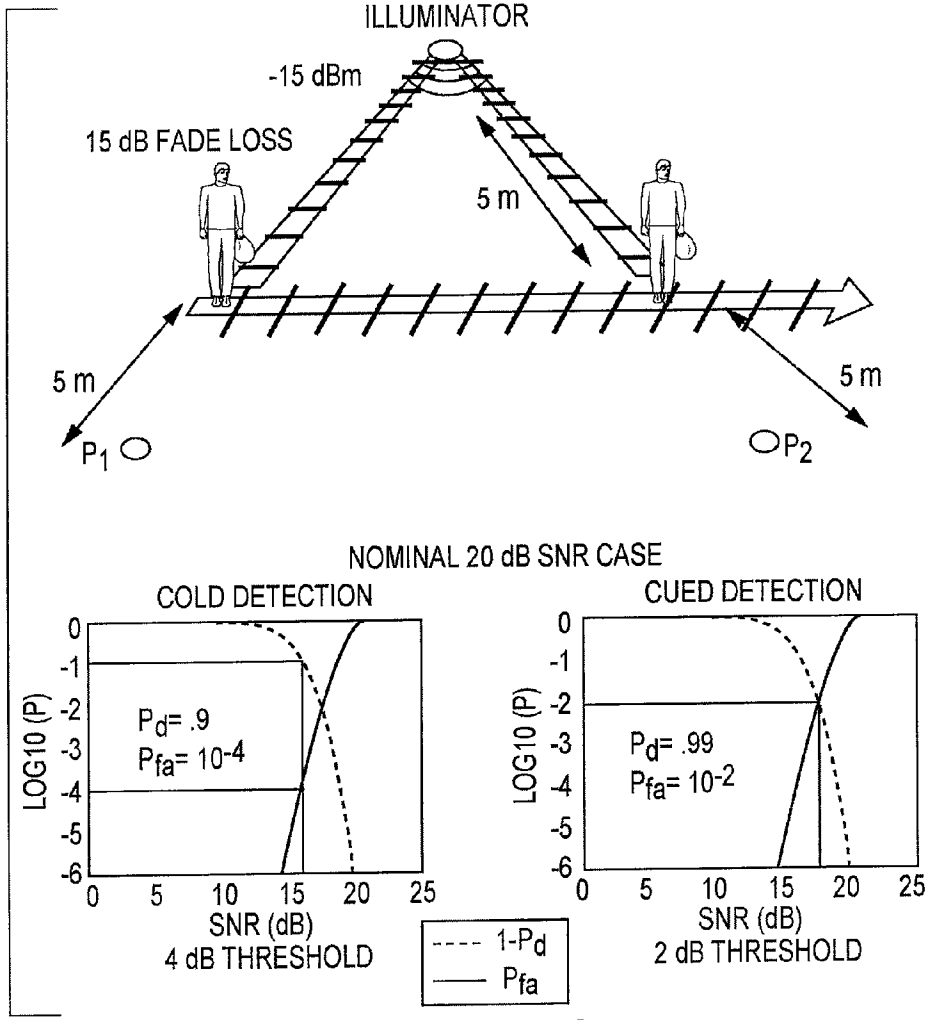

FIG. 9C plots probability versus SNR. The blue line (B) indicates the probability that the 20-dB signal plus noise exceeds the SNR. The green line (A) indicates the probability that the signal reduced by 6 dB is less than the SNR. For received signals 20 dB above the noise, a 6-dB cold detection threshold would be set to provide a $P_D$ of about 90% and a false alarm rate of $10^{-4}$. If the pebble then cues neighboring pebbles to reduce their threshold to detect a 4-dB drop in signal level, the reduced threshold would be more likely to trigger cued detections, and these detections will serve to improve detection performance (and indicate intruder movement). If the cold threshold were retained by the neighboring pebbles, rather than the cued threshold, further cold detections would not occur as readily and, as a result, would not provide intruder movement indication.

The cueing mechanism for reducing the detection threshold for 20-dB signal to noise may not provide better detection performance than other strategies, such as reporting any events beyond a very low threshold (like 2 dB) and taking M out of N as a basis for declaring a detection. However, given that the pebbles need to minimize transmission time and power for energy conservation, the cueing approach may prove optimal.

Note that multiple illumination frequencies may be needed to reduce interference associated with a pebble receiving the combined signal of multiple blockage-sensing illuminators. For example, if a pebble is receiving signals at comparable strengths and at the same frequency from two or more illuminators, intruder blockage from one of the illuminators could be masked, or jammed, by the signals of the unblocked illuminators. If neighboring illuminators operate on different frequencies and each of the detection pebbles is tuned to only one of the illumination frequencies, or, alternately, could be tuned to discriminate different illuminations, this interference problem could be alleviated.

For the desired detection performance, it was previously mentioned that an illuminator pebble must provide 20-dB signal to noise at 20 GHz to a receiving pebble at approximately 10-m range. The feasibility of a continuously transmitting illuminator from a power consumption viewpoint has been considered. It is estimated that a −15-dBm transmit power is sufficient (assuming omnidirectional 20-GHz antennas, a 100-kHz receive bandwidth, 3-dB receive noise figure, 3 dB losses on transmit and receive, and a 15-dB propagation loss). For an overall efficiency of less than 5%, it is estimated that the total power consumption could be on the order of 1 mW.

The mote design description in Culler indicates a 3-W-hr battery, which would indicate up to 3000 hours of continuous operation of an illuminator. A 1-$cm^2$ solar panel that can generate 10 mW of power in full sunlight would extend operation. A pulsed system could also be considered to minimize power consumption. Such a system would increase complexity, requiring clock synchronization between the illuminating and receiving pebbles. Finally, because the pebbles are considered expendable, periodic replacement of blockage-sensing illuminators with depleted batteries would likely be economical.

To summarize the pebbles' logic rules based on the analysis for the above-identified communications and blockage-sensing design parameter values:

- Sensor node pebbles are distributed to fall generally within 10 m of each other to ensure shadow depth and blockage-sensing illuminator signal strength 20 dB above noise. Efforts are made to minimize multipath and absolute blockages.
- Blockage-sensing illuminator pebbles are distributed generally 20 m apart, possibly with different tone settings near 20 GHz. Each of these special pebbles continuously transmits or transmits a pulse train for energy savings.
- The sensor pebbles have the following logic characteristics:
  - Do not respond if the steady received signal is measured to be less than 20 dB above noise.
  - A cold detection threshold is preset or modified by a remote transmitter command after assessing false alarm performance. It is nominally for a 6-dB drop in signal due to blockage.
  - A cued threshold is preset or modified by a remote transmitter command. It is nominally set for a 4-dB drop in signal due to blockage.
  - One or more remote receivers are placed within line of sight of the pebble field from 1 to 20 km, depending on receiver antenna size.
  - The receiver is set to indicate a detection of a minimum number of pebbles within its antenna beam based on detection performance, to further regulate false alarm performance, and to ensure incoherent power combining.

Consider the inventive swarming sensor node/pebbles security monitoring network concept described above utilizing microwave tones. The basic assumption of the swarming pebbles concept is that inter-pebble and pebble field-to-remote receiver propagation losses are approximately constant and predictable. Then pebble transmit power can be 'set' to only allow near-neighbor pebbles to receive 'cue' tones. It may turn out that actual propagation loss is highly variable over seconds to minutes by 10 s of dB. For example, the microwave communications fade detection algorithm considered in the 1990's factored in Wallops Island test data that indicated that microwave band fading, at least at multi-km ranges, could vary 10-20 dB over 10 s of seconds. In that case, many more pebbles could receive cues, or only a very few would.

The following is a very simple analysis of what would occur in a swarming pebble field for extreme propagation conditions. Following that, additional network design features are proposed for consideration in the prototypes to accommodate propagation variations while retaining network stability and performance.

Consider a 'pebble field' with 20 m separation over about a 4 $km^2$ area. This could be represented by 10,000 pebbles covering approximately a 2 km by 2 km square pebble field or a long rectangle, say 0.25 km×16 km, along a pipeline or on the periphery of a utility complex such as a power plant. Assume also that the pebbles reset to their cold, uncued, detection thresholds every 10 seconds so that cumulative probabilities do not need to be considered.

Propagation loss variations can greatly alter network performance. For example, if a total swing of plus or minus 18 db of propagation would occur, then a 20 m nominal communication range between pebbles would reduce to 2.5 m or increase to 106 m. Case 2 coincides with the former case and Case 1 below considers a version of the latter case.

Consider the following limiting cases:

Case 1. Perfect propagation.

In this case, e.g., strong propagation ducting, if one pebble makes a cold detection and emits a cueing tone, all other pebbles receive the cue and set their more sensitive cued detection thresholds. A cold detection threshold is assumed with $P_d$=(approx.) 0.9 and $P_{fa}$=(approx.) $10^{-4}$. A cold detection cues all other 9,999 pebbles to the cued threshold with $P_d$=(approx.) 0.99 and $P_{fa}$=(approx.) $10^{-2}$.

Case 2. No propagation.

In this case, e.g., extreme blockages, if as pebble makes a cold detection and emits a cueing tone, no other pebbles receive the cue. Therefore, all 10,000 pebbles remain at the cold detection threshold of $P_d$=(approx.) 0.9 and $P_{fa}$=(approx.) $10^{-4}$.

Case 3. Intermediate threshold.

In this case, assume all pebbles retain a single cold threshold of $P_d$=(approx.) 0.95 and $P_{fa}$=(approx.) $10^{-3}$, with no cueing.

For each case in the table below, the longer term average number of false alarm detections per 10,000 pebbles is shown in the second column. Assuming a directional antenna for the remote transceiver that covers 0.1 of the pebble field area (0.4 $km^2$), column 3 indicates the average number of false alarms per antenna beam position. If the remote transceiver is set to detect 5-10 pebbles, minimum, then 5-10 false alarms among pebbles in a beam would cause a remote transceiver reception to indicate an intruder. Columns 4 and 5 illustrate the probability of cumulative detection $P_d$ for 5 pebbles within a beam and probability of false alarm $P_{fa}$ with a cold detection plus 4 cued detections (for Case 1) and 5 cold detections in Cases 2 and 3. The table also shows nominal operation performance in addition to the 3 cases.

| Case | Number of False Alarms per 10,000 pebbles | Number of False Alarms . . . in remove receiver antenna of beam covers 1/10 pebble area | Percentage of 5 pebbles can be detected per beam (cold plus cued) $P_d$ | $P_{fa}$ |
|---|---|---|---|---|
| 1 | 100 | 10 | Approx . . . 9 | $10^{-12}$ |
| 2 | I | Approx.0 | Approx . . . 6 | $10^{-20}$ |
| 3 | 10 | Approx.1 | Approx . . . 8 | $10^{-15}$ |
| Nominal Performance | 1 | Approx.0 | Approx . . . 9 | $10^{-12}$ |

Case 1 indicates that a cold intruder detection made by a pebble that cues all other pebbles would yield a $P_{fa}$ of $10^{-12}$ and $P_d$ of 0.9. However, if the pebble making the cold detection sends a cue signal that is received by all pebbles in the field, then the resulting per-pebble false alarm probability of $10^{-2}$ implies that over the 10 second interval about 10 false alarms per beam would light up all beam positions and prevent localization of the intruder.

Conversely, Case 2 with essentially no propagation would result in only cold detections. An intruder would undergo a series of 5 cold detections with a cumulative probability of detection of 0.6 and probably of false alarm of $10^{-20}$. This is not a very high probability of detection.

If under conditions of uncertain propagation all pebbles are ordered, via the remote monitor, to set cold thresholds of $10^{-3}$ $P_{fa}$ and $P_d$ of 0.95, and no cueing were allowed, then an intruder would be detected with 5 cold detections with cumulative $P_d$ of 0.8 and $P_{fa}$ of $10^{-15}$.

These cases suggest several possible options in pebble network design. Common to all three cases is the need to take some form of measurement of propagation conditions as they likely vary over seconds, minutes, or hours. Measurements could take the form of either direct measurement of propagation loss or signal strength or monitoring the false alarm density as inference of propagation effects. To first order, local effects such as specular multipath from buildings or blockage from shrubs or ridges will not have an overall negative sensitivity impact on performance. Blind spots (poor propagation) or enhanced sensitivity zones (enhanced signals) may influence when a detection is made or whether an intruder 'track' is maintained consistently, but overall network performance is likely essentially maintained.

In the interest of only minimal design feature additions to maintain low cost, the following are design options.

Periodically all pebbles could be commanded by the remote monitors to send tones at a test frequency (other than the frequency of the cue tone). This may be cheaper than having clocks in the pebbles for periodic test transmissions at prescribed times (regular or random). Depending on received signal strengths, the pebbles would change receiver sensitivity or gain of transmitter or receiver amplifier analogous to sensitivity time control (STC) and automatic gain control (AGC). The remote transceiver monitors themselves could also adjust receiver sensitivity or gain to ensure a detection threshold for the prescribed number of pebble tones per beam (e.g., 5-10) based on the test tones.

This is probably the most robust of the options. AGC and STC circuits are well known and inexpensive, and the network would be balanced automatically. The most likely drawback is power consumption. However, the test tone could be in much less than a second (but over enough time to account for the longest multipath distances). There is also a greater potential for alerting an intruder of the existence of the pebble field, and this would favor limiting transmit power rather than receiver gain or sensitivity. This approach also allows for monitoring by the remote receiver of areas where pebbles have lost power and may require reseeding of fresh, fully charged pebbles.

In a field of, for example, 10,000 pebbles, false alarm statistics per beam may be gathered by the remote transceiver. This is analogous to 'clutter mapping' in radars. If a remote monitor never makes a detection of random false alarms per beam position, perhaps via a high sensitivity test receiver channel, then it is likely that either nominal performance or Case 2 performance is in effect. If, however, the transceiver is detecting 2 or more apparently random false alarms in more than one beam position, this would be indicative of Case 1 low propagation loss. One option under this condition would be for the remote receiver to command the pebbles in that area to a nominal Case 3 condition. Whereas detection performance is somewhat lower than the nominal case, it might be adequate.

An alternative approach to false alarm monitoring is manual. If the remote monitor receives no detections of random false alarms in the beam positions, denoting either Case 2 or nominal operation, then a no-cost alternative could be to have a person walk through a pebble field on occasion or to trigger a few dispersed test pebbles to emit tones to test the response of the field.

The advantage of the false alarm monitoring approach, although less robust and less automatic than the AGC/STC approach, is that no additional design feature would be required for the 10,000 pebbles except the ability to receive a command to change to a Case 3 threshold setting.

Even without having made detailed measurements of propagation, consideration of extreme propagation cases provides insight into simple means to ensure network stability in terms of detection probability and false alarm control regardless of the type of sensor used. If circuit chips already in production (such as in Mote transceivers) contain AGC or STC options, or if additional circuitry were easily integrated, then automated tone testing appears to be the most automatic and robust means to ensure that cued detection with constant false alarm rate (CF AR) control is maintained.

Although the above example is for the microwave band, other bands are applicable such as millimeter, infrared, visual, and ultraviolet wavelengths. In these cases calculations of intruder blockage and communications design characteristics would need to account for the different propagation and scattering effects of these other wavelength regimes. For example, at ultraviolet wavelengths intruder blockage would be similar in behavior to a visible shadow, whereas near-earth, over-terrain propagation may be predominately due to atmospheric scatter rather than terrain diffraction and multipath which can predominate in the microwave region.

While the invention has been described with reference to example embodiments, it will be understood by those skilled in the art that a variety of modifications, additions and deletions are within the scope of the invention, as defined by the following claims.

What is claimed is:

1. A security zone monitoring system comprising:

a plurality of sensor nodes dispersed in the security zone, wherein each sensor node transmits a communication without protocols other than a rudimentary language or signal to alert its neighboring sensor nodes when the sensor node detects an intrusion into the security zone and the alerted neighboring sensor nodes that also detect the intrusion transmit the communication to alert their neighboring sensor nodes, the communication continuing to be transmitted by and through the plurality of sensor nodes that detect the intrusion until the intrusion is no longer detected, whereby an increase in the communication transmissions between the plurality of sensor nodes detecting the intrusion increases a total power density in the security zone; and a transceiver located remotely from the security zone for detecting and localizing the increase in the total power density and for providing an alert of the intrusion.

2. The security zone monitoring system as recited in claim 1, wherein the transmitted communication comprises a first tone.

3. The security zone monitoring system as recited in claim 2, wherein the first tone comprises different frequencies.

4. The security zone monitoring system as recited in claim 2, wherein a portion of the plurality of sensor nodes also transmit a communication comprising a second tone, the second tone being transmitted continuously and being received continuously by neighboring sensor nodes, whereby the intrusion will block the transmission of the second tone thereby causing a receiving neighboring sensor node to detect a resulting drop in the received second tone power and, as a result, to transmit a first tone to its neighboring sensor nodes.

5. The security zone monitoring system as recited in claim 1, wherein the transceiver can modify the programming of the plurality of sensor nodes.

6. The security zone monitoring system as recited in claim 5, wherein the transceiver can modify a detection threshold of the plurality of sensor nodes.

7. The security zone monitoring system as recited in claim 1, wherein a detection threshold of each of the plurality of sensor nodes is pre-set high to ensure a low false alarm rate, the detection threshold being lowered after receiving the communication transmission from a neighboring sensor node.

8. The security zone monitoring system as recited in claim 1, wherein the plurality of sensor nodes are pre-set to search for a specific characteristic.

9. The security zone monitoring system as recited in claim 8, wherein the specific characteristic comprises one of a human voice, a human movement, and a molecule produced by a human.

10. The security zone monitoring system as recited in claim 1, the transceiver further comprising a directional antenna.

11. The security zone monitoring system as recited in claim 10, the system further comprising at least three transceivers for triangulating the received signals to further localize the intrusion location.

12. The security zone monitoring system as recited in claim 1, further comprising one or both of a video camera and an alarm for receiving the alert from the transceiver.

13. The security zone monitoring system as recited in claim 1, wherein the transceiver is one of a microwave transceiver and a millimeter wave transceiver.

14. The security zone monitoring system as recited in claim 1, wherein the transceiver transmits one of infrared, visible, and ultraviolet electromagnetic (EM) waves.

15. The security zone monitoring system as recited in claim 1, further comprising means for accommodating propagation variations of the communication transmissions to maintain the stability and performance of the plurality of sensor nodes.

16. The security zone monitoring system as recited in claim 15, the means for accommodating comprising means for monitoring the false alarms by the plurality of sensor nodes.

17. The security zone monitoring system as recited in claim 15, the means for accommodating comprising one or both of sensitivity time control and automatic gain control.

18. The security zone monitoring system as recited in claim 1, each of the plurality of sensor nodes comprising:

a small sensor;

a power supply;

a transceiver;

a controller integrated circuit; and a container for protecting and disguising the sensor node.

19. The security zone monitoring system as recited in claim 18, each sensor node further comprising a solar array.

20. The security zone monitoring system as recited in claim 18, wherein the small specific sensor comprises one or more of acoustic, chemical, optical, and biological.

21. The security zone monitoring system as recited in claim 18, further comprising means for determining the direction of the received communication.

22. The security zone monitoring system as recited in claim 18, wherein the transceiver is one of a microwave transceiver and a millimeter wave transceiver.

23. The security zone monitoring system as recited in claim 18, wherein the transceiver transmits one of infrared, visible, and ultraviolet electromagnetic (EM) waves.

24. A security zone monitoring system comprising:

a plurality of transmitters, the transmitters continuously transmitting electromagnetic (EM) waves;

a plurality of receivers randomly dispersed in the security zone for receiving the transmitted EM waves, each of the plurality of receivers able to communicate with its neighboring receivers;

wherein an intrusion into the security zone will block the EM wave transmission of one or more of the EM wave transmitters thereby causing one or more of the receivers to detect a resulting drop in the received EM wave transmissions indicating the presence of the intrusion and to communicate a detection to its neighboring receivers.

25. The security zone monitoring system as recited in claim 24, wherein the plurality of transmitters is one of a microwave transmitter and a millimeter wave transmitter.

26. The security zone monitoring system as recited in claim 24, wherein the plurality of transmitters transmits one of infrared, visible, and ultraviolet electromagnetic (EM) waves.

27. A security zone monitoring system comprising a transceiver located remotely from the security zone for detecting and localizing an increase in the total incoherent power density resulting from communications between a plurality of transmitters located in the security zone when an intrusion is detected by the plurality of transmitters and for providing an alert of the intrusion.

28. A method for monitoring a security zone comprising:

dispersing a plurality of sensor nodes in the security zone;

transmitting a communication without protocols other than a rudimentary language or signal between the plurality of sensor nodes that detect an intrusion into the security zone, the communication continuing to be transmitted by and through the plurality of sensor nodes that detect the intrusion until the intrusion is no longer detected, whereby an increase in the communication transmissions between the plurality of sensor nodes detecting the intrusion increases a total power density in the security zone; and detecting and localizing the increase in the total power density and providing an alert of the intrusion.

29. The method for monitoring the security zone as recited in claim 28, wherein the transmitted communication comprises a first tone.

30. The method for monitoring the security zone as recited in claim 29, wherein the first tone comprises different frequencies to further localize the intrusion.

31. The method for monitoring the security zone as recited in claim 29, further comprising:

transmitting a communication comprising a second tone between a portion of the plurality of the sensor nodes, the second tone being transmitted continuously;

receiving the second tone continuously by the portion of the plurality of sensor nodes, whereby the intrusion will block the transmission of the second tone thereby causing the receiving portion of the plurality of sensor nodes to detect a resulting drop in the received second tone power and, as a result, to transmit a first tone.

32. The method for monitoring the security zone as recited in claim 28, further comprising modifying the programming of the plurality of sensor nodes.

33. The method for monitoring the security zone as recited in claim 32, wherein the modified programming comprises a detection threshold of the plurality of sensor nodes.

34. The method for monitoring the security zone as recited in claim 28, further comprising:

pre-setting a detection threshold of each of the plurality of sensor nodes high to ensure a low false alarm rate; and lowering the pre-set detection threshold after receiving the communication transmission.

35. The method for monitoring the security zone as recited in claim 28, further comprising pre-setting the plurality of sensor nodes to search for a specific characteristic.

36. The method for monitoring the security zone as recited in claim 28, further comprising using at least three transceivers for triangulating the received total power density signals to further localize the intrusion location.

37. The method for monitoring the security zone as recited in claim 28, wherein the transmissions are one of a microwave and a millimeter wave.

38. The method for monitoring the security zone as recited in claim 28, wherein the transmissions are one of infrared, visible, and ultraviolet electromagnetic (EM) waves.

39. The method for monitoring the security zone as recited in claim 28, further comprising accommodating propagation variations of the communication transmissions to maintain the stability and performance of the plurality of sensor nodes.

40. The method for monitoring the security zone as recited in claim 39, further comprising monitoring the false alarms by the plurality of sensor nodes.

41. The method for monitoring the security zone as recited in claim 39, further comprising using one or both of sensitivity time control and automatic gain control.

42. A method for monitoring a security zone comprising:

continuously transmitting electromagnetic (EM) waves using a plurality of transmitters; and receiving the transmitted EM waves using a plurality of receivers, the plurality of receivers being randomly dispersed in the security zone and each of the plurality of receivers being able to communicate with its neighboring receivers;

wherein an intrusion into the security zone will block the EM wave transmission of one or more of the plurality of transmitters thereby causing one or more of the plurality of receivers to detect a resulting drop in the received EM wave transmission indicating the presence of the intrusion and to communicate a detection to its neighboring receivers.

43. The method for monitoring the security zone as recited in claim 42, wherein the transmitter is one of a microwave transmitter and a millimeter wave transmitter.

44. The method for monitoring the security zone as recited in claim 42, wherein the transmitter transmits one of infrared, visible, and ultraviolet EM waves.

45. A method for monitoring a security zone comprising the step of detecting and localizing an increase in a total incoherent power density using a transceiver located remotely from the security zone, the detected and localized power density resulting from communications between a plurality of transmitters located in the security zone when an intrusion is detected by the plurality of transmitters.

* * * * *